US007566210B2

(12) United States Patent
Elson et al.

(10) Patent No.: US 7,566,210 B2
(45) Date of Patent: Jul. 28, 2009

(54) HORIZONTAL SCROLL COMPRESSOR

(75) Inventors: John P Elson, Sidney, OH (US); Shawn W Vehr, Dayton, OH (US); William E Ramey, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 180 days.

(21) Appl. No.: 11/255,140

(22) Filed: Oct. 20, 2005

(65) Prior Publication Data

US 2007/0092391 A1 Apr. 26, 2007

(51) Int. Cl.
*F01C 21/04* (2006.01)
*F01C 1/04* (2006.01)

(52) U.S. Cl. ..... 418/55.6; 418/55.1; 418/89; 418/94; 418/DIG. 1

(58) Field of Classification Search ..... 418/55.6, 418/55.1, 89, 94, 100, 97, 270, DIG. 1; 417/410.5; 184/6.18, 6.16
See application file for complete search history.

(56) References Cited

U.S. PATENT DOCUMENTS

| | | | | |
|---|---|---|---|---|
| 3,462,072 | A | 8/1969 | Schibbye | |
| 3,777,509 | A | 12/1973 | Muench | |
| 3,796,526 | A | 3/1974 | Cawley | |
| 3,945,216 | A | 3/1976 | Schibbye | |
| 4,080,119 | A | 3/1978 | Eriksson | |
| 4,112,701 | A | 9/1978 | Schibbye et al. | |
| 4,140,337 | A | 2/1979 | Arcella et al. | |
| 4,289,334 | A | 9/1981 | Riley | |
| 4,312,187 | A | 1/1982 | Myers | |
| 4,343,599 | A | 8/1982 | Kousokabe | |
| 4,400,020 | A | 8/1983 | Keller | |
| 4,439,121 | A | 3/1984 | Shaw | |
| 4,449,895 | A | 5/1984 | Kurahayashi | |
| 4,456,437 | A | 6/1984 | Kurahayashi et al. | |
| 4,470,772 | A | 9/1984 | Gannaway | |
| 4,470,778 | A * | 9/1984 | Mabe | 418/55.6 |
| 4,477,233 | A | 10/1984 | Schaefer | |
| 4,623,306 | A | 11/1986 | Nakamura et al. | |
| 4,674,963 | A | 6/1987 | Morishita et al. | |
| 4,676,075 | A | 6/1987 | Shibayashi | |

(Continued)

FOREIGN PATENT DOCUMENTS

| | | | |
|---|---|---|---|
| JP | 06-010859 | A | 1/1994 |

OTHER PUBLICATIONS

"S391 Screw Compressor Specifications," Thermo King Northwest, copyright 2002, 1 page.

(Continued)

*Primary Examiner*—Thomas E Denion
*Assistant Examiner*—Mary A Davis
(74) *Attorney, Agent, or Firm*—Harness, Dickey & Pierce, P.L.C.

(57) ABSTRACT

A horizontal scroll-type compressor utilizes the pressure differential between the discharge pressure and the suction pressure to route lubricant from the discharge chamber to the components within the intake chamber. The compressor may utilize a lubricant separator within the discharge chamber to separate the working fluid from the lubricant prior to the working fluid exiting the compressor. The compressor may use an internal passageway that extends from the discharge chamber to a position adjacent the crankshaft to provide lubricant to the internal lubricant passage within the crankshaft.

20 Claims, 4 Drawing Sheets

U.S. PATENT DOCUMENTS 4,758,136 A 7/1988 Pamlin et al.
4,818,198 A 4/1989 Tamura et al.
4,850,197 A 7/1989 Taylor et al.
4,863,357 A 9/1989 Olofsson
4,895,498 A 1/1990 Basseggio
4,898,521 A 2/1990 Sakurai et al.
4,917,582 A 4/1990 Fraser, Jr. et al.
4,946,361 A 8/1990 DeBlois et al.
5,027,606 A 7/1991 Short
5,037,282 A 8/1991 Englund
5,040,382 A 8/1991 Abraham
5,063,750 A 11/1991 Englund
5,076,771 A 12/1991 Ban et al.
5,102,316 A * 4/1992 Caillat et al. ..... 418/55.5
5,103,652 A 4/1992 Mizuno et al.
5,110,268 A 5/1992 Sakurai et al.
5,112,201 A 5/1992 Tamura et al.
5,131,497 A 7/1992 Rogers
5,137,437 A 8/1992 Machida et al.
5,197,868 A 3/1993 Caillat et al.
5,228,301 A 7/1993 Sjoholm et al.
5,246,357 A 9/1993 Sjoholm et al.
5,277,564 A 1/1994 Tamura et al.
5,328,340 A 7/1994 Hara et al.
5,345,785 A 9/1994 Sekigami et al.
5,358,392 A 10/1994 Ukai
5,370,513 A 12/1994 Fain
5,385,453 A * 1/1995 Fogt et al. ..... 418/58
5,391,066 A 2/1995 Sawai et al.
5,466,136 A 11/1995 Yamada et al.
5,580,230 A 12/1996 Keifer et al.
5,580,233 A 12/1996 Wakana et al.
5,591,018 A 1/1997 Takeuchi et al.
5,630,712 A 5/1997 Sakai et al.
5,634,345 A 6/1997 Alsenz
5,645,408 A 7/1997 Fujio et al.
5,660,539 A 8/1997 Matsunaga et al.
5,667,371 A 9/1997 Prenger et al.
5,678,986 A 10/1997 Terauchi et al.
5,678,987 A 10/1997 Timuska
5,683,237 A 11/1997 Hagiwara et al.
5,685,168 A 11/1997 Sada
5,727,936 A 3/1998 Eriksson et al.
5,735,139 A 4/1998 Lord et al.
5,810,572 A 9/1998 Yamamoto et al.
5,829,959 A 11/1998 Tsubono et al.
5,931,650 A 8/1999 Yasu et al.
5,964,581 A 10/1999 Iizuka et al.
6,017,205 A * 1/2000 Weatherston et al. ..... 418/55.6
6,039,551 A 3/2000 Takeuchi et al.
6,044,660 A 4/2000 Numoto et al.
6,053,715 A 4/2000 Hirano et al.
6,071,100 A * 6/2000 Yamada et al. ..... 418/55.6
6,086,343 A 7/2000 Sun et al.
6,116,877 A 9/2000 Takeuchi et al.
6,167,719 B1 1/2001 Yakumaru et al.
6,171,076 B1 1/2001 Gannaway
6,183,227 B1 2/2001 Hida et al.
6,220,839 B1 4/2001 Sheridan et al.
6,227,828 B1 5/2001 Takeuchi et al.
6,264,446 B1 7/2001 Rajendran et al.
6,273,693 B2 8/2001 Hida et al.
6,322,339 B1 11/2001 Mitsunaga et al.
6,422,842 B2 7/2002 Sheridan et al.
6,428,296 B1 8/2002 Elson et al.
6,457,562 B1 * 10/2002 Sun ..... 418/55.6
6,461,132 B1 10/2002 Sun et al.
6,467,287 B2 10/2002 Sjoholm et al.
6,478,551 B1 11/2002 Nonaka
6,478,557 B2 11/2002 Shiibayashi et al.
6,499,967 B2 12/2002 Hansen
6,506,039 B1 1/2003 Osumimoto et al.
6,511,530 B2 1/2003 Iwanami et al.
6,616,415 B1 * 9/2003 Renken et al. ..... 417/44.1
6,682,322 B2 1/2004 Funakoshi et al.
6,718,781 B2 4/2004 Freund et al.
6,739,833 B2 5/2004 Makino et al.
6,896,496 B2 5/2005 Haller et al.
2001/0038797 A1 11/2001 Makino et al.
2002/0051719 A1 * 5/2002 Shiibayashi et al. ..... 418/55.6
2003/0059319 A1 3/2003 Haller et al.
2004/0191082 A1 * 9/2004 Gennami et al. ..... 417/310

OTHER PUBLICATIONS

"The Rotary Vane Principle," http://www.hydrovane.co.uk/vaneprinciples1.asp?area=,2 pages, printed Dec. 22, 2005.

* cited by examiner

HORIZONTAL SCROLL COMPRESSOR

FIELD OF THE INVENTION

The present invention relates generally to scroll-type machines. More particularly, the present invention relates to a horizontal scroll-type compressor with an improved lubrication system for providing lubricating oil from the discharge pressure zone to the oil passage in the crankshaft.

BACKGROUND AND SUMMARY OF THE INVENTION

Scroll machines in general, and particularly scroll compressors, are often disposed in a hermetic shell which defines a chamber within which is disposed a working fluid. A partition within the shell often divides the chamber into a discharge pressure zone and a suction pressure zone. In a low-side arrangement, a scroll assembly is located within the suction pressure zone for compressing the working fluid. Generally, these scroll assemblies incorporate a pair of intermeshed spiral wraps, one or both of which are caused to orbit relative to the other so as to define one or more moving chambers which progressively decrease in size as they travel from an outer suction port towards a center discharge port. An electric motor is normally provided which operates to cause this relative orbital movement.

The partition within the shell allows compressed fluid exiting the center discharge port of the scroll assembly to enter the discharge pressure zone within the shell while simultaneously maintaining the integrity between the discharge pressure zone and the suction pressure zone. This function of the partition is normally accomplished by a seal which interacts with the partition and with the scroll member defining the center discharge port.

The discharge pressure zone of the hermetic shell is normally provided with a discharge fluid port which communicates with a refrigeration circuit or some other type of fluid circuit. In a closed system, the opposite end of the fluid circuit is connected with the suction pressure zone of the hermetic shell using a suction fluid port extending through the shell into the suction pressure zone. Thus, the scroll machine receives the working fluid from the suction pressure zone of the hermetic shell, compresses the working fluid in the one or more moving chambers defined by the scroll assembly, and then discharges the compressed working fluid into the discharge pressure zone of the compressor. The compressed working fluid is directed through the discharge port through the fluid circuit and returns to the suction pressure zone of the hermetic shell through the suction port.

Typically, scroll-type compressors have been designed as either a vertical or a horizontal scroll compressor. The horizontal configuration may be necessitated due to space constraints in the application in which the scroll compressor is to be employed. A primary difference between the vertical and horizontal scroll compressor designs stems from the fact that the lubrication sump and delivery systems have needed to be specifically adapted for a vertical or horizontal configuration. The present invention resides in the discovery of a unique lubrication system for a horizontal-type scroll compressor that delivers lubrication fluid from the discharge pressure zone to the lubricant passage in the crankshaft in the suction pressure zone of the compressor system. The lubrication system may also accommodate movement of the horizontal-type scroll compressor, such as when employed on a mobile platform, while still providing a sufficient flow of lubricant.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

The following description of the preferred embodiment is merely exemplary in nature and is in no way intended to limit the invention, its application, or uses.

Figure 1:
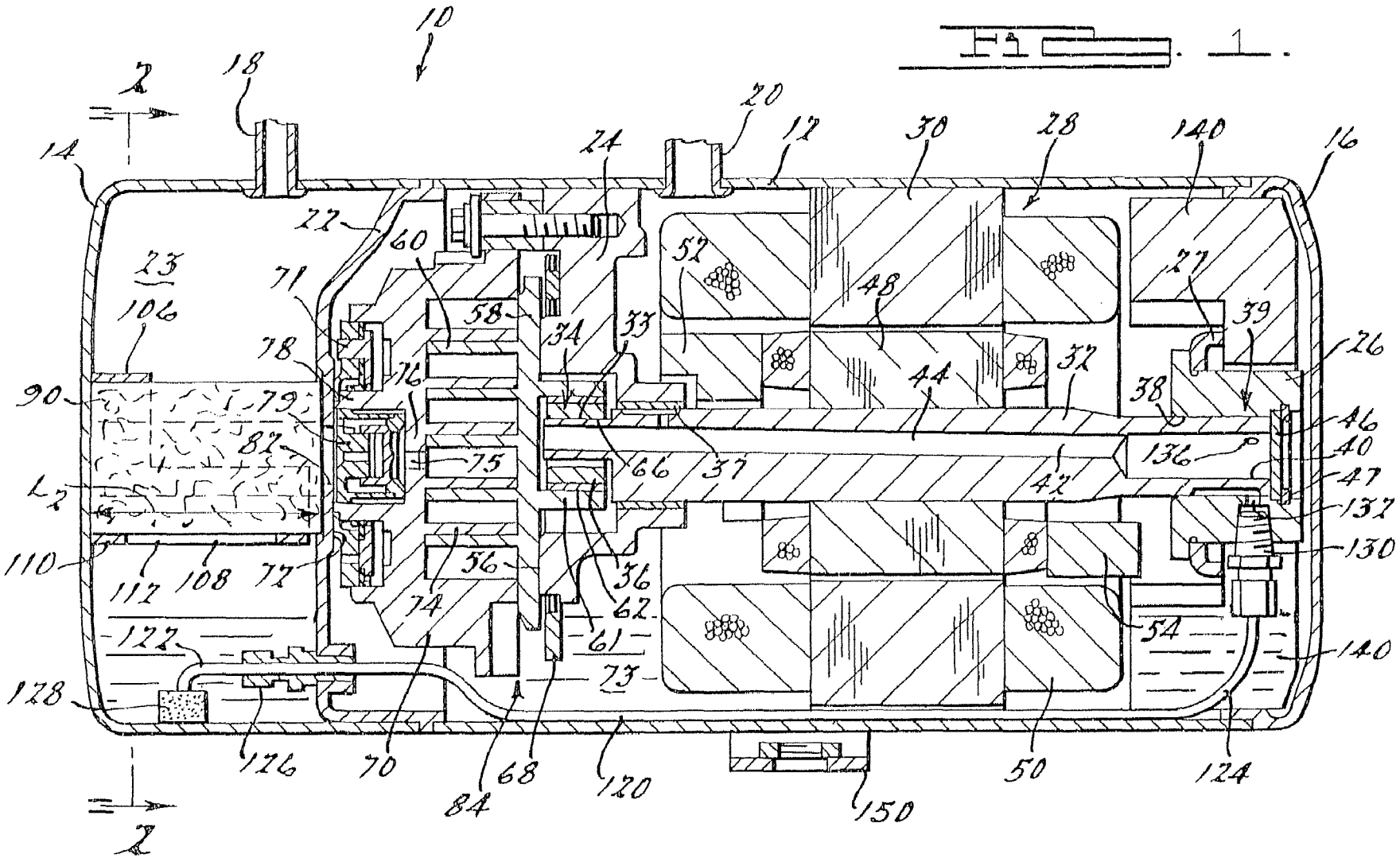
FIG. 1 is vertical sectional view through the center of a horizontal scroll compressor which incorporates the lubricant delivery system of the present invention.

While the present invention is suitable for incorporation with many different types of scroll machines, for exemplary purposes, it will be described herein incorporated in a scroll compressor of the general structure illustrated in FIG. 1. Referring now to the drawings, and in particular to FIG. 1, a compressor 10 is shown which comprises a generally cylindrical hermetic shell 12 having welded at opposing ends thereof caps 14, 16. Cap 14 is provided with a discharge fitting 18 which may have the usual discharge valve therein. Other major elements affixed to shell 12 include an inlet fitting 20, a transversely extending partition 22 which is welded about its periphery at the same point that cap 14 is welded to cylindrical shell 12. A discharge chamber 23 is defined by cap 14 and partition 22.

A main bearing housing 24 having a plurality of radially outwardly extending legs is secured to the cylindrical shell 12. A second bearing housing 26 is secured to a mounting plate 27 which extends outwardly and is secured to cylindrical shell 12. A motor 28 which includes a stator 30 is supported within cylindrical shell 12 between main bearing housing 24 and second bearing housing 26. A crankshaft 32 has an eccentric crankpin 33 at one end 34 thereof. Crankpin 33 is rotatably journaled in an orbiting scroll bearing 36, as described in more detail below. Orbiting scroll bearing 36 has a circular outer diameter. End 34 of crankshaft 32 is also rotatably journaled in a main bearing 37 in main bearing housing 24 while the opposite end 39 of crankshaft 32 is rotatably journaled in a second main bearing 38 in second bearing housing 26.

Crankshaft 32 has, at a second end 39, a relatively large diameter concentric bore 40 which communicates with a radially outwardly smaller diameter bore 42 extending therefrom to first end 34 of crankshaft 32. Bores 40, 42 form an internal lubricant passage 44 in crankshaft 32. A sealing member or plate 46 is disposed within the inner bore of second bearing housing 26 and is secured therein with a snap ring 47. Second end 39 of crankshaft 32 pushes against sealing plate 46 during operation to encourage the flow of lubricant within lubricant passage 44 and inhibit the lubricant from exiting crankshaft 32 through second end 39. A small gap exists between end 39 of crankshaft 32 and sealing plate 46 when motor 28 is not energized.

Crankshaft 32 is rotatably driven by electric motor 28 including rotor 48 and stator windings 50 passing therethrough. Rotor 48 is press fitted on crankshaft 32 and includes first and second counterweights 52 and 54, respectively.

A first surface of the main bearing housing 24 is provided with a flat thrust bearing surface 56 against which is disposed an orbiting scroll 58 having the usual spiral vane or wrap 60 on a first surface thereof. Projecting from the second surface of orbiting scroll 58 is a cylindrical hub 61 having a journal bearing 62 therein. Rotatably disposed within bearing 62 is orbiting scroll bearing 36 which has a D-shaped inner bore 66 in which crankpin 33 is drivingly disposed. The crankpin has a flat on one surface which drivingly engages the flat surface of bore 66 to provide a radially compliant driving arrangement, such as shown in assignee's U.S. Pat. No. 4,877,382, the disclosure of which is hereby incorporated herein by reference.

An Oldham coupling 68 is disposed between orbiting scroll 58 and bearing housing 24. Oldham coupling 68 is keyed to orbiting scroll 58 and a non-orbiting scroll 70 to prevent rotational movement of orbiting scroll member 58. Oldham coupling 68 is preferably of the type disclosed in assignee's U.S. Pat. No. 5,320,506, the disclosure of which is hereby incorporated herein by reference. A floating seal 71 is supported by the non-orbiting scroll 70 and engages a seat portion 72 mounted to the partition 22 for sealingly dividing an intake chamber 73 from discharge chamber 23.

Non-orbiting scroll 70 is provided having a wrap 74 positioned in meshing engagement with wrap 60 of orbiting scroll 58. Non-orbiting scroll 70 has a centrally disposed discharge passage or port 75 defined by a base plate portion 76. Non-orbiting scroll 70 also includes an annular hub portion 78 which surrounds the discharge passage 75. A unitary shut down device or discharge valve 79 can be provided in discharge passage 75. Discharge valve 79 is preferably always open during operation of compressor 10 such that it is not dynamically opening and closing during operation. When operation of compressor 10 ceases, discharge valve 79 closes. During operation of compressor 10, working fluid and lubricant flow from intake chamber 73 through lower scroll intake 84 and into the chambers formed between wraps 60, 74 and are subsequently discharged through discharge passage 75, discharge valve 79 and through an opening 82 in partition 22 and on into a lubricant separator 90.

Figure 2:
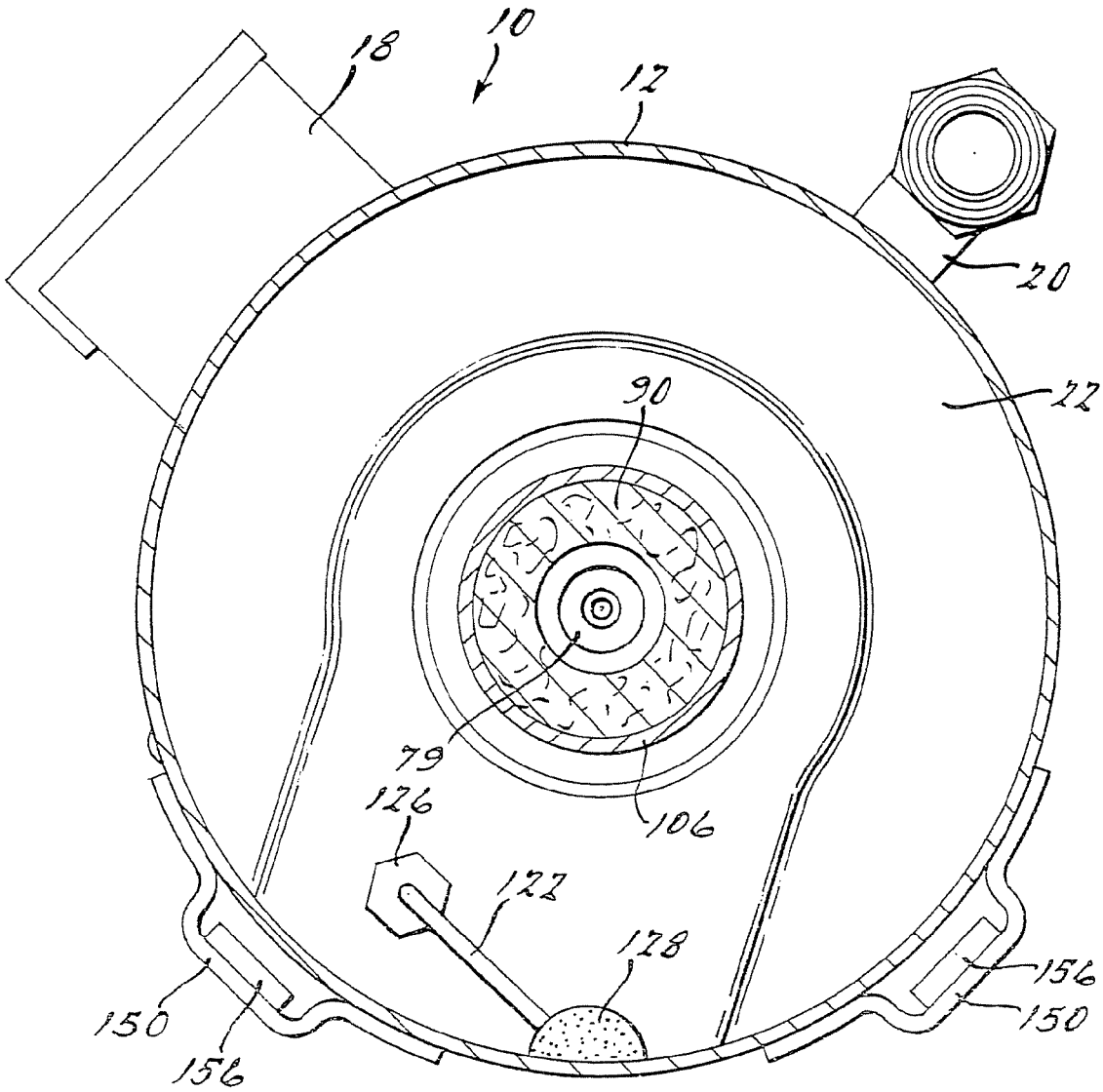
FIG. 2 is a sectional side view of the horizontal scroll compressor along line 2-2 of FIG. 1.
Figure 3:
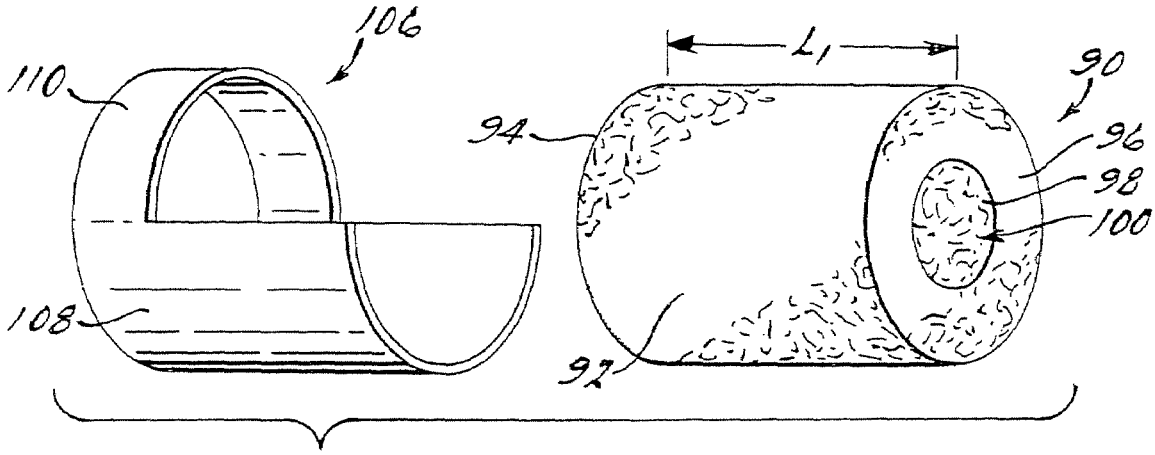
FIG. 3 is an exploded view of the lubricant separator and the holder used in the horizontal scroll compressor of FIG. 1.
Figure 4:
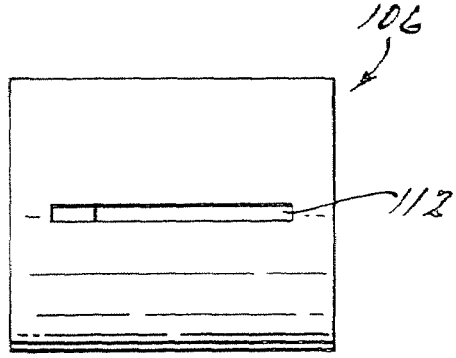
FIG. 4 is a bottom plan view of the holder of FIG. 3 showing the discharge slot therein.

Referring now to FIGS. 1-4, details of lubricant separator 90 utilized in compressor 10 are shown. Separator 90 is generally a walled cylinder with an outer surface 92, opposite ends 94, 96 and an uncompressed length $L_1$ therebetween, as shown in FIG. 3. An opening 98 in end 96 communicates with an interior 100 of separator 90. End 96 abuts partition 22 with openings 82, 98 generally aligned. Opening 98 thereby communicates with discharge passage 75 of non-orbiting scroll 70 via discharge valve 79. Separator 90 is formed from a metal wire mesh having a desired mesh density and/or open area. For example, for a steel separator a mesh density of 10% by weight may be utilized. The wire diameter may be of various values. For example, a wire diameter of 0.006 inches may be utilized. It should be appreciated, however, that other types of material, densities and diameters can be used to form the mesh.

Compressed working fluid and lubricant exit discharge valve 79 and flow into interior 100 of separator 90. Within separator 90, a substantial amount of the lubricant is separated from the working fluid with the lubricant collecting within lower portion of discharge chamber 23 and the working fluid flowing out through discharge fitting 18. For example, separator 90 may be configured to remove 99% or more of the lubricant from the working fluid.

A metal holder 106 is configured to hold separator 90 within discharge chamber 23 of compressor 10. Holder 106 includes a trough portion 108 which supports a majority of separator 90. Holder 106 also includes an annular portion 110 that encircles a portion of outer surface 92 and end 94 of separator 90. A slit or slot 112 in trough 108 allows lubricant to drain from separator 90 and holder 106 to accumulate in the lower portion of discharge chamber 23. It should be appreciated that other types of openings can be employed in trough portion 108 and/or annular portion 110 to allow lubricant to drain from holder 106. For example, a plurality of apertures can be disposed along trough 108 and/or annular portion 110 to allow lubricant within separator 90 to flow via gravity to the lower portion of discharge chamber 23.

Holder 106 is secured to end cap 114 and compresses separator 90 to a compressed length of $L_2$ ($L_2$ being less than $L_1$), as shown in FIG. 1, when installed in compressor 10. That is, when end cap 14 is attached to shell 12, the dimensions of discharge chamber 23 cause separator 90 to be compressed between partition 22 and end cap 14. Compression of separator 90 helps to retain separator 90 in a desired position within discharge chamber 23.

Figure 6:
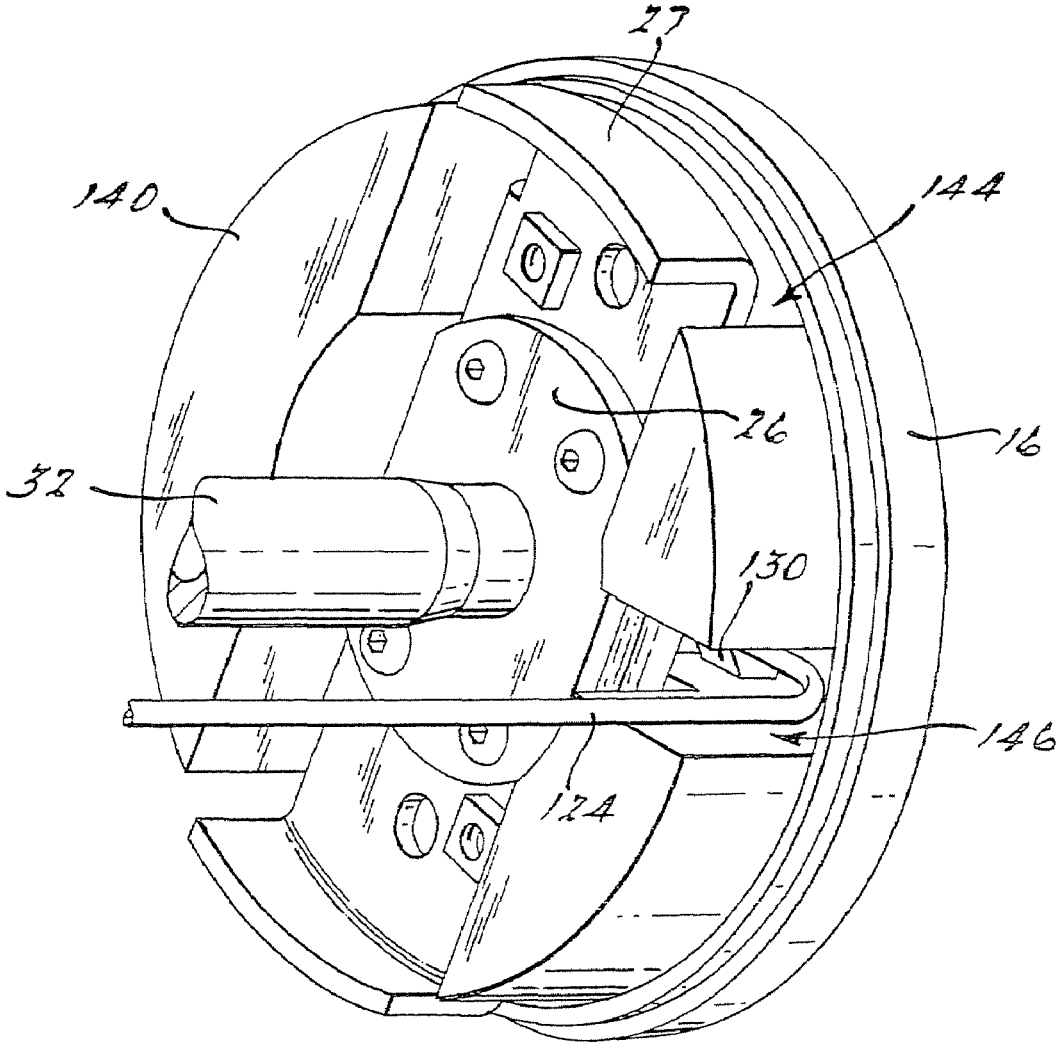
FIG. 6 is a perspective view of a portion of the horizontal scroll compressor of FIG. 1 with various components removed to illustrate the configuration of the right end of the compressor.

Referring now to FIGS. 1, 2 and 6, a lubricant feed line/passageway 120 extends from the lower portion of discharge chamber 23 to bearing housing 26. Lubricant feed passageway 120 communicates with discharge chamber 23 and lubricant passage 44 of crankshaft 32 and supplies lubricant from discharge chamber 23 to lubricant passage 44. The lubricant is forced through lubricant feed passageway 120 due to the pressure differential between discharge chamber 23 (at discharge pressure) and intake chamber 73 (at suction pressure). Lubricant feed passageway 120 is formed by tubing members 122, 124, such as copper tubing, interconnected by a fitting 126. Fitting 126 extends through partition 22. A screen or filtering element 128 is attached to the open end of tubing member 122 and inhibits debris or other foreign matter from entering lubricant feed passageway 120. Another fitting 130 interconnects tubing member 124 with a bore 132 in bearing housing 26. Suitable fittings are available from Swagelok Company of Solon, Ohio. Crankshaft 32 has multiple openings or bores 136 adjacent end 39 extending from large bore 40 to an exterior of crankshaft 32.

A majority of the lubricant flowing through bore 132 in bearing housing 26 flows into lubricant passage 44 in crankshaft 32 via openings 136 while the remaining lubricant flows around the exterior of crankshaft 32 and lubricates bearing 38. The quantity of lubricant delivered to lubricant passage 44 affects the efficiency and performance of compressor 10. Thus, controlling the quantity of lubricant flowing through crankshaft 32 is important. The size and/or diameter of screen 128, tubing 122, 124, fittings 126, 130, bore 132 and openings 136 affect the quantity of lubricant flowing into lubricant passage 44 in crankshaft 32. Thus, these dimensions are chosen to provide a desired lubricant flow rate for the nominal pressure differential expected to occur between discharge chamber 23 and intake chamber 73 during operation of compressor 10.

Of particular note is the function of openings 136 in controlling the quantity of lubricant delivered to lubricant passageway 44. Openings 136 are sized to meter the flow of lubricant based upon the pressure differential and to provide a desired percentage of open area in the region of bore 132. The percentage of open area is a function of the number of openings 136 in crankshaft 32 and the size of the openings 136. As a result of the size and number of openings 136, lubricant flowing through bore 132 will sometimes see openings 136 and other times will see the solid exterior surface of crankshaft 32. The percentage of open area is chosen based upon the nominal pressure differential expected to occur between discharge chamber 23 and intake chamber 73 during operation of the compressor. Thus, the number of openings 136 and/or the size of the openings 136 can be adjusted to provide a desired flow rate of lubricant into lubricant passageway 44. Additionally, the use of multiple openings 136 to provide the desired percentage of open area enables larger openings to be utilized, as opposed to systems wherein lubricant flows through a passageway in crankshaft 32 that is exposed to a lubricant passageway 100% of the time. As a result, more accurate metering of lubricant flowing into lubricant passageway 44 may be achieved. Moreover, openings 136 are preferably located on crankshaft 32 in a non-load bearing region. That is, a portion of crankshaft 32 within bearing 38 will be load bearing and ride upon a lubricant film disposed between the exterior of crankshaft 32 and bearing 38. The pressure developed in this load-bearing region is relatively high. By locating openings 136 in a non-load bearing portion of crankshaft 32, these high pressures can be avoided and, as a result, proper metering of lubricant into lubricant passageway 44 via openings 136 can be achieved. The use of two openings 136 spaced 180° apart facilitates the manufacturing of crankshaft 32. That is, by having two openings 180° apart, a simple drilling or boring operation can be performed on crankshaft 32 to form both of the openings. Thus, the use of opposing openings facilitates the manufacture of crankshaft 32.

Figure 5:
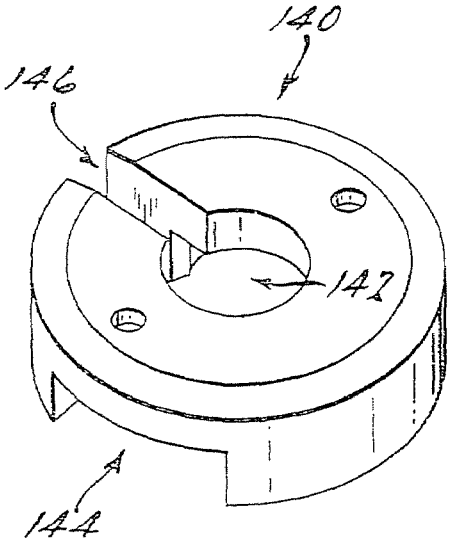
FIG. 5 is a perspective view of the space filling component used in the horizontal scroll compressor of FIG. 1.

A space filling component 140, shown in FIGS. 1, 5 and 6, is disposed within intake chamber 73 adjacent end cap 16. Space filling component 140 is generally cylindrical and is configured to occupy a majority of the space between motor 28 and end cap 16 that would otherwise be empty or void. The use of space filling component 140 reduces the empty space (voids) within intake chamber 73 and, thus, limits the location and/or quantity of lubricant within intake chamber 73. This is especially important when compressor 10 is utilized in a mobile application or platform, such as a vehicle, tractor, aircraft and the like. In such applications, compressor 10 may be subjected to tilting of up to 30 degrees or more along all three-dimensional axes. By eliminating some of the voids within intake chamber 73, adequate positioning and supplying of lubricant to the components of compressor 10 can be realized, regardless of the tilting of compressor 10. Additionally, limiting the location of the lubricant may facilitate atomizing the lubricant within the working fluid by the rotating rotor and counterweight 48, 54.

Space filling component 140 includes a central opening 142 within which a hub portion of bearing housing 26 is disposed. Space filling component 140 also includes a channel 144 on one end thereof within which mounting plate 27 and a part of bearing housing 26 are disposed. Space filling component 140 is secured to mounting plate 27. Space filling component 140 also includes a cutout 146 to accommodate tubing member 124 and fitting 130. Space filling component 140 is preferably solid and can be made from a variety of materials. Preferably, space filling component 140 is made from aluminum due to the proximity to the location where end cap 16 will be welded to shell 12 and to be lightweight. It should be appreciated, however, that other materials can be employed and that space filling component 140 may be hollow.

Figure 7B:
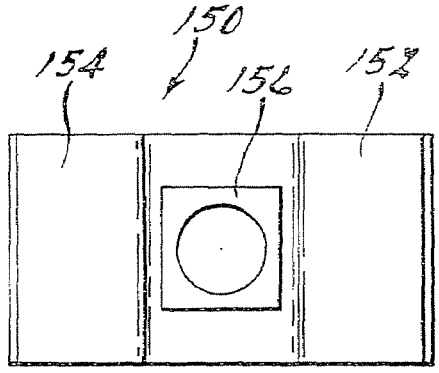
FIGS. 7A and B are respective side and top plan views of the bracket used on the exterior of the horizontal scroll compressor of FIG. 1.
Figure 7A:
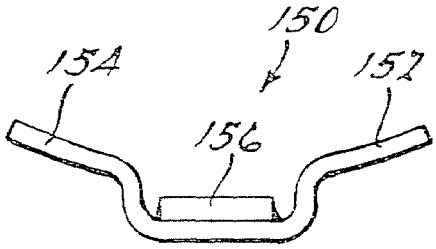

Referring now to FIGS. 1, 2 and 7, brackets 150 for mounting compressor 10 to another component are shown. Brackets 150 include two legs 152, 154 that are secured to shell 12. A weld nut 156 is disposed in a central portion of each bracket 150. Weld nut 156 facilitates the attachment of compressor 10 to another component. For example, a mounting bracket having one or more grommets can be attached to each bracket 150 via weld nut 156. The grommets would help dampen vibration of compressor 10 when mounted in place. In the present invention, two brackets 150 spaced 90 degrees apart are utilized to secure compressor 10 to a desired component. It should be appreciated, however, that brackets 150 can take other forms and can be more or less than two without departing from the spirit and scope of the present invention.

In operation, motor 28 is energized and causes rotor 48 to take a particular orientation within the field generated by stator windings 50. The movement of rotor 48 causes crankshaft 32 to move to the right with the movement of rotor 48. The movement of crankshaft 32 to the right causes end 39 to seal against sealing plate 46. Energizing motor 28 also causes crankshaft 32 to begin rotating about its axis, thereby causing orbiting scroll 58 to move relative to non-orbiting scroll 70. This rotation pulls working fluid into intake chamber 73. Within intake chamber 73, working fluid and lubricant mix together and are pulled into lower scroll intake 84 and between the wraps 60, 74 of orbiting and non-orbiting scrolls 58, 70. The working fluid and lubricant are compressed therein and discharged through discharge passage 75 and discharge valve 79 at the discharge pressure. The discharged working fluid and lubricant flow into lubricant separator 90 wherein the working fluid passes through the mesh of separator 90 and the lubricant therein is entrapped by the mesh. The entrapped lubricant, via gravity, flows into trough 108 and through slot 112 to bottom portion of discharge chamber 23. The working fluid flows out of discharge chamber 23 through discharge fitting 18 and into the system within which compressor 10 is utilized. If the system is a closed system, the working fluid, after passing through the system, flows back into intake chamber 73 of compressor 10 via inlet fitting 20.

The pressure differential between discharge chamber 23 and intake chamber 73 forces lubricant within discharge chamber 23 to flow into and through lubricant feed passageway 120 and into bore 132 of bearing housing 26. A portion of the lubricant flowing into bore 132 flows into lubricant passage 44 in crankshaft 32 via openings 136. The remaining portion of lubricant flowing into bore 132 flows around the exterior of crankshaft 32 and lubricates bearing 38. The lubricant within lubricant passage 44 flows, via rotation of crankshaft 32, to the left and toward bearing housing 24. Openings (not shown) along the end of crankshaft 32 adjacent bearing housing 24 allow the lubricant therein to exit lubricant passage 44 and lubricate the exterior of crankshaft 32, bearing 36, journal bearing 62 and Oldham coupling 68. The lubricant then drops into lower portion of intake chamber 73. The lubricant within intake chamber 73 may form into a mist that is mixed with the working fluid flowing through intake chamber 73.

Thus, the lubrication system utilized with the horizontal-type compressor is self contained. The lubrication system is contained entirely within the hermetic shell 12 and does not receive lubrication from an external lubricant source. That is, compressor 10 does not require the use of a dedicated external lubricant supply to supply lubrication to the components of compressor 10. Rather, the only external lubrication flowing into compressor 10 is that contained within the working fluid that is not removed by separator 90 and flows through the system through which the working fluid passes prior to re-entering compressor 10 via inlet fitting 20. Thus, compressor 10 according to the principles of the present invention, via the use of an internal lubricant separator, avoids the necessity of using an external lubricant source to separate lubricant from the working fluid and subsequently provide the lubricant to the appropriate components of compressor 10. This configuration advantageously allows for the entire lubrication system to be contained within shell 12 and reduces the overall size and space required for compressor 10.

According to the present invention, a horizontal-type compressor can utilize the pressure differential between the discharge pressure and the suction pressure to route lubricant throughout the compressor. In addition, the lubricant system can supply the required lubrication while the horizontal-type compressor is pivoted up to 30 degrees or more about its three axes. Furthermore, it should be understood that while the lubrication system of the present invention is shown as being employed within a horizontal scroll-type compressor, the lubrication system may be employed in other types of compressors. Moreover, the lubrication system may also be able to be employed within a vertical compressor, although all of the benefits of the present invention may not be realized. Additionally, while the present invention is shown on a horizontal compressor with the motor within the shell, the invention can also be utilized in an open-drive compressor wherein the motor is external to the shell and drives a shaft that extends through the shell.

As used herein, the term "hermetic" means being completely sealed regardless of the method of sealing. By way of non-limiting example, the sealing may be achieved by welding, brazing, gaskets, O-rings, sealants and the like.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A compressor comprising:

a shell;

a discharge chamber defined within said shell and operating at a first pressure;

an intake chamber defined within said shell and operating at a second pressure;

a compression mechanism disposed within said intake chamber configured to move a fluid from said intake chamber to said discharge chamber;

a crankshaft disposed within said intake chamber and drivingly engaged with said compression mechanism;

a partition within said shell separating said discharge chamber from said intake chamber;

two bearing housings disposed within said intake chamber and each rotatably supporting different portions of said crankshaft, a first one of said bearing housings supporting a proximal end portion of said crankshaft adjacent said compression mechanism, and a second one of said bearing housings supporting a distal end portion of said crankshaft; and a closed lubricant passageway contained in said shell and having first and second ends such that lubricant in said lubricant passageway only enters and exits said lubricant passageway through said first and second ends, said lubricant passageway extending from said discharge chamber into said second bearing housing with said first end disposed in said discharge chamber and said second end disposed in said second bearing housing, said lubricant passageway thereby providing direct fluid communication between said discharge chamber and said second bearing housing with lubricant therein flowing from said discharge chamber directly to said second bearing housing, and said lubricant passageway being exterior to said compression mechanism and passing through said partition.

2. The compressor of claim 1, wherein said compression mechanism includes first and second scroll members and said lubricant passageway is exterior to said scroll members.

3. The compressor of claim 1, wherein said compressor is a horizontal compressor.

4. The compressor of claim 1, wherein said partition is a component separate and discrete from said compression mechanism.

5. The compressor of claim 1, further comprising a motor disposed within said intake chamber, said motor drivingly engaged with said crankshaft.

6. The compressor of claim 1, further comprising a lubricant separator located within said discharge chamber and in communication with an outlet of said compression mechanism.

7. The compressor of claim 1, further comprising a filter member in communication with said lubricant passageway, said filter located upstream of said lubricant passageway.

8. The compressor of claim 1, wherein said lubricant passageway is at least partially formed by a tube member and a fitting.

9. The compressor of claim 1, wherein said shell is a hermetic shell.

10. A compressor comprising:

a shell;

a discharge chamber defined within said shell and operating at a discharge pressure;

an intake chamber defined within said shell and operating at a suction pressure less than said discharge pressure;

a compression mechanism disposed within said intake chamber configured to move a fluid from said intake chamber at said suction pressure to said discharge chamber at said discharge pressure;

a partition within said shell separating said discharge chamber from said intake chamber;

a crankshaft having opposite first and second crankshaft ends and disposed within said intake chamber, said second end drivingly engaged with said compression mechanism, and said crankshaft extending substantially horizontally within said shell;

a bearing housing disposed within said intake chamber and rotatably supporting a portion of said crankshaft; and a first lubricant passageway extending from said discharge chamber into said bearing housing, said first lubricant passageway having first and second lubricant passageway ends such that lubricant in said first lubricant passageway enter and exits said first lubricant passageway through said first and second lubricant passageway ends, said first lubricant passageway end is disposed in said discharge chamber and said second lubricant passageway end is disposed in said bearing housing, said first lubricant passageway providing direct fluid communication between said discharge chamber and said bearing housing, and said first lubricant passageway passes through said partition, wherein said crankshaft includes a second lubricant passageway extending therein from said first crankshaft end to said second crankshaft end, said crankshaft includes at least one opening extending radially inwardly through an exterior portion thereof adjacent said first crankshaft end and in communication with said second lubricant passageway in said crankshaft, said lubricant at said discharge pressure flows from said discharge chamber and through said intake chamber prior to flowing into said second lubricant passageway in said crankshaft, said first lubricant passageway directs said lubricant at said discharge pressure into said second lubricant passageway in said crankshaft through said at least one opening, and said lubricant flows through said second lubricant passageway and out said second crankshaft end as a result of a pressure differential between said discharge pressure and said suction pressure.

11. The compressor of claim 10, wherein said at least one radially extending opening is located in a non-load bearing section of said crankshaft.

12. The compressor of claim 10, wherein said compression mechanism includes first and second scroll members and said lubricant passageway is exterior to said scroll members.

13. The compressor of claim 10, wherein said compressor is a horizontal compressor.

14. The compressor of claim 10, wherein said partition is a component separate and discrete from said compression mechanism.

15. The compressor of claim 10, further comprising a motor disposed within said intake chamber, said motor drivingly engaged with said crankshaft.

16. The compressor of claim 10, further comprising a lubricant separator located within said discharge chamber and in communication with an outlet of said compression mechanism.

17. The compressor of claim 10, further comprising a filter member in communication with said lubricant passageway, said filter located upstream of said lubricant passageway.

18. The compressor of claim 10, wherein said lubricant passageway is at least partially formed by a tube member and a fitting.

19. The compressor of claim 10, wherein said shell is a hermetic shell.

20. The compressor of claim 10, wherein lubricant in said first lubricant passageway only enters and exits said first lubricant passageway through said first and second lubricant passageway ends.

* * * * *